United States Patent [19]

Hughes et al.

[11] Patent Number: 4,767,353

[45] Date of Patent: Aug. 30, 1988

[54] TWO PART CONNECTOR HOUSINGS IN STRIP FORM

[75] Inventors: Donald W. K. Hughes, Mechanicsburg; Donald L. Metzger, Harrisburg, both of Pa.

[73] Assignee: AMP Incorporated, Harrisburg, Pa.

[21] Appl. No.: 526,945

[22] Filed: Aug. 29, 1983

[51] Int. Cl.[4] ..... H01R 13/502

[52] U.S. Cl. ..... 439/398; 439/590; 439/937

[58] Field of Search ..... 339/59 R, 59 M, 276 SF, 339/97 R, 97 P, 98, 99 R; 439/590, 395–408, 937, 686, 695, 701, 710

[56] References Cited

U.S. PATENT DOCUMENTS

| | | | |
|---|---|---|---|
| 2,823,789 | 2/1958 | Henning | 339/276 SF |
| 2,964,171 | 12/1960 | Chadwick | 339/276 SF |
| 4,210,379 | 7/1980 | Vachhani et al. | 339/59 M |
| 4,220,384 | 9/1980 | Clark et al. | 339/59 M |
| 4,230,387 | 10/1980 | Zahn | 339/59 M |
| 4,317,608 | 3/1982 | Dechelette | 339/99 R |
| 4,405,193 | 9/1983 | Weidler | 339/97 P |
| 4,423,916 | 1/1984 | Muehlhausen, II | 339/59 M |

*Primary Examiner*—Gil Weidenfeld
*Assistant Examiner*—Gary F. Paumen
*Attorney, Agent, or Firm*—Frederick W. Raring; Robert W. Pitts; Robert W. J. Usher

[57] ABSTRACT

A continuous strip of connector housing material is described which comprises a succession of housing segments that are latched together at their ends. Each segment contains a plurality of individual housing cells that are connected to each other by severable webs. The latches between juxtaposed segments are also severable. A connector housing of a desired size, as the regards the number of terminals therein, is obtained by severing from the end of the strip the desired number of housing cells. The connectors thus produced may be of the type which require a closure member which is fitted into the wire receiving ends of the cells. A continuous strip of closure members are also provided. The housings may by of either the feed-through type which are installed on wires intermediate the wire ends, or they may be of a wire end type, which are installed on the ends of wires.

3 Claims, 6 Drawing Sheets

TWO PART CONNECTOR HOUSINGS IN STRIP FORM

FIELD OF THE INVENTION

This invention relates to multi-contact electrical connectors of the type comprising an insulating housing having cavities extending therethrough and having contact terminals in the housing which receive wires. The invention is particularly directed to the provision of such connectors in varying sizes as regards the number of terminals in the housing.

BACKGROUND OF THE INVENTION

A commonly used type of multi-contact electrical connector comprises an insulating housing having a mating face, a wire receiving face which faces oppositely with respect to the mating face, oppositely facing housing sidewalls, oppositely facing endwalls, and side-by-side cavities extending through the housing from the wire receiving face to the mating face. Electrical contact terminals are contained in the cavities and each terminal has a wire receiving slot so that wires can be connected to the terminals by moving the wires laterally of their axes and into the wire receiving slots. U.S. Pat. No. 4,405,193, filed June 8, 1981, shows a connector of this general type.

In harness manufacturing operations, there may be a need for connectors of the type described above having different numbers of contact terminals and there is also a need for two different types of connectors; one type, referred to as a feed-through connector, which is designed to be installed on wires intermediate the ends of the wires and another type, the wire end type, which is designed to be installed on the ends of the wires.

Ordinarily, the requirement for many different sizes and types of connectors is satisfied by making a special mold for each type of connector required and producing the individual types and sizes of connectors which are required for a particular electrical harness. It can be appreciated that this approach to the problem of providing different types and sizes of connectors results in relatively high tooling cost for the harness manufacturer and it also results in high inventory requirements on the part of the manufacturer since he must maintain a stock of all of the types of connectors he needs for his manufacturing operations.

The present invention is directed to the achievement of connector housings in the form of individual segments which can be latched or otherwise joined to each other to produce a connector housing having any desired number of electrical contact positions or terminals. The invention is further directed to the achievement of a continuous strip of connector housing material that can be cut to a desired length to produce a housing of the desired size.

A multi-contact electrical connector assembly in accordance with one embodiment of the invention is of the type comprising a connector housing and end closure members. The housing has a mating face and a wire-receiving face which faces oppositely with respect to the mating face, oppositely facing housing sidewalls and oppositely facing housing endwalls extend from the mating face to the wire-receiving face. A plurality of cavities extend through the housing from the wire-receiving face to the mating face, the cavities being side-by-side in a row which extends between the housing endwalls. Each of the cavities has an electrical contact terminal therein of the type having a wire receiving slot adjacent to the wire-receiving face. At least one of the housing sidewalls has wire admitting slots therein at the wire-receiving face which are in alignment with the terminals so that wires can be moved laterally of their axes and inserted into the wire-receiving slots and the inserted wires will then extend through the wire-admitting slots. The end closure members are dimensioned for insertion into the cavities at the wire receiving face to retain the wires in the slots in the terminals. The connector assembly is characterized in that the housing comprises a plurality of individual housing cells, the cells being connected to each other by integral connecting cell webs which extend between the cells at the wire-receiving face. The end closures are in strip form and are connected to each other by closure webs. The cell webs and the closure webs are in alignment when the closures are inserted into the cavities and the cell webs and the closure webs are severable upon relative movement of a severing blade through the cell webs and the closure webs. In accordance with a further embodiment, the assembly has one juxtaposed pair of cells which are connected to each other by interengaged latches which are provided in the juxtaposed pair of cells a the wire-receiving face of the connector. The pitch of the one juxtaposed pair of cells is the same as the pitch of the remaining cells of the connector assembly and the interengaged latches are severable upon relative movement of a severing blade through the interengaged latches.

A further embodiment comprises a continuous strip of connector housing material which, when severed, produces multi-contact electrical connectors. The multi-contact electrical connectors thus produced each comprises an insulating housing having a mating face and a wire-receiving face which faces oppositely with respect to the mating face, oppositely facing housing sidewalls and oppositely facing housing endwalls extend from the mating face to the wire-receiving face. A plurality of cavities extend through the housing from the wire-receiving face to the mating face, the cavities being side-by-side in a row which extends between the housing endwalls. Each of the cavities has an electrical contact terminal therein of the type having a wire receiving slot adjacent to the wire-receiving face. At least one of the housing sidewalls has wire admitting slots therein at the wire receiving face which are in alignment with the terminals so that wires can be moved laterally of their axes and inserted into the wire-receiving slots and the inserted wires will then extend through the wire-admitting slots. The continuous strip of connector housing material is characterized in that the strip comprises a continuous string of housing cells, each cell having a mating cell face and a wire-receiving cell face which faces oppositely with respect to the mating cell face. Each cell has oppositely facing cell sidewalls which face laterally of the strip and oppositely facing cell endwalls, juxtaposed cells in the strip having their endwalls opposed to each other. Juxtaposed cells in the string are connected to each other by integral cell webs which extend between the juxtaposed cells at the wire-receiving faces thereof and are severable from each other upon severing the cell webs connecting the juxtaposed cells whereby a multi-contact electrical connector is produced by severing the desired number of cells from the end of the strip. In accordance with a further embodiment, the opposed cell endwalls of the juxtaposed cells in the strip are spaced apart whereby the continuous strip can be convolutely wound on a reel. A further embodiment is characterized in that that continuous strip is made up of a series of segments, each segment comprising a plurality of cells, the cells at the ends of each segment being connected to the end cells of juxtaposed segments by interengaged latches. The interengaged latches are severable upon relative movement of a severing blade through the interengaged latches.

DESCRIPTION OF THE DRAWINGS

FIG. 1 shows an electrical harness 2 composed of discreet wires 4 and multi-contact electrical connectors 6, 8, 10. The connectors 6 are of the wire end type and are so called for the reason that they are designed to be installed on the ends of wires 4. The connector 8 is of the feed-through type and is adapted to be installed on wires intermediate the ends thereof so that the wires pass through the connector and to the connector 10. The connector 10 is a composite type in that some of the wires extend through the connector while other wires have the ends connected to terminals in the connector. Connectors of any of the types shown can be produced in accordance with the invention as will be described below.

Figure 1:
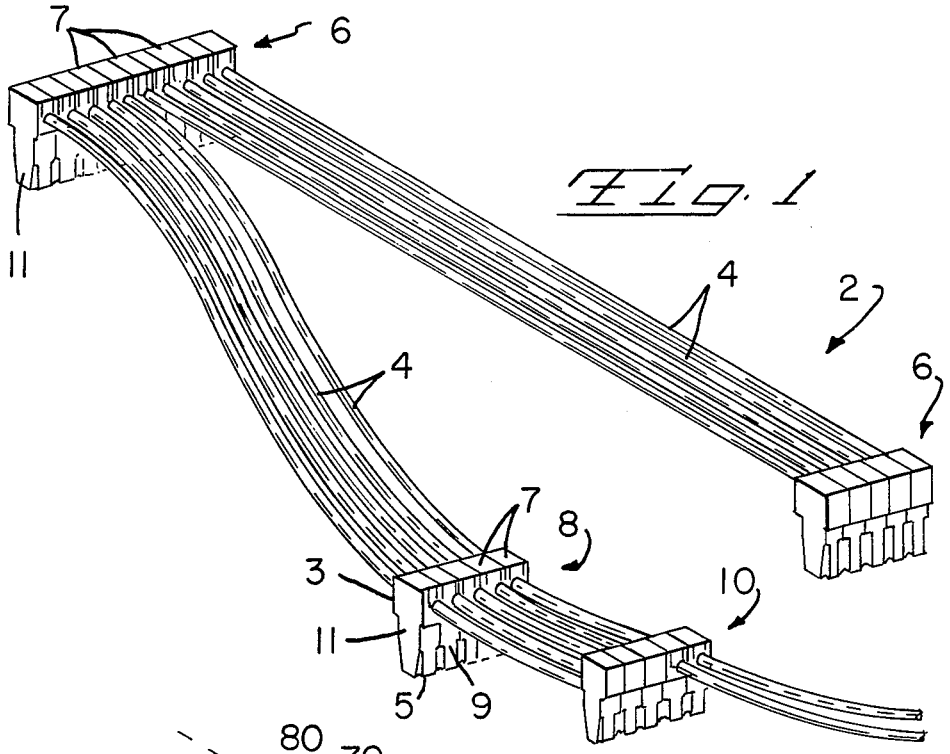
FIG. 1 is a perspective view of an electrical harness having connectors in accordance with the invention installed on the wires of the harness.
Figure 3:
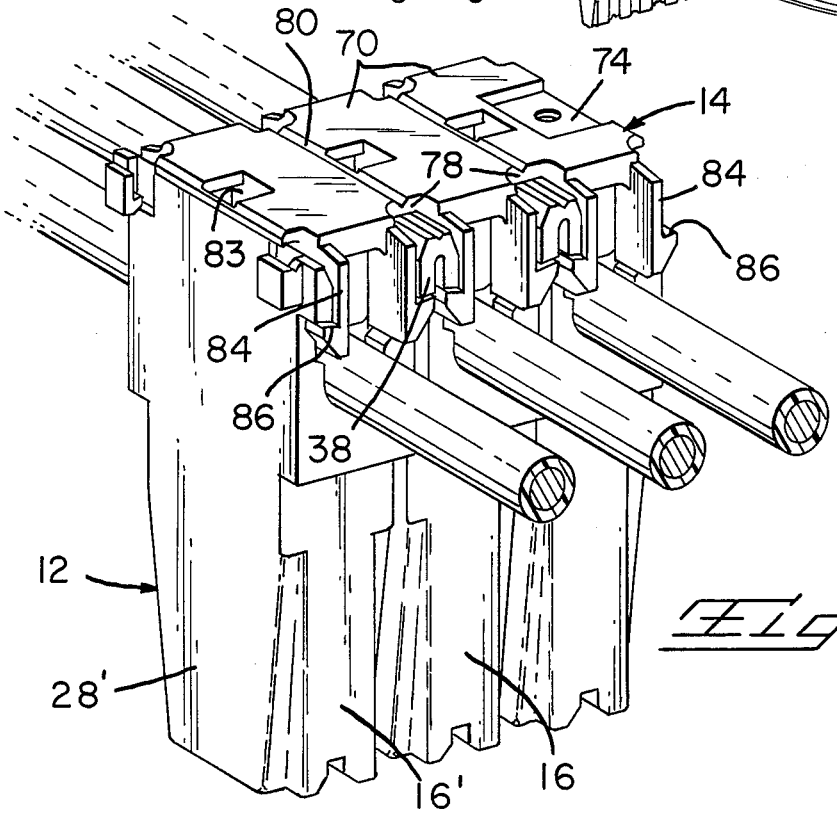
FIG. 3 is a perspective view of a housing segment installed on wires.

All of the connectors 6, 8, 10 comprise a molded insulated housing 3 which has a mating face 5, a wire receiving face 7, oppositely facing housing sidewalls 9, and oppositely facing endwalls 11. A plurality of cavities extend through the housing and each cavity contains an electrical terminal as will be described below.

In the description which follows, the connector 8 will first be described and wire end connectors as shown at 6 will then be described.

Figure 2:
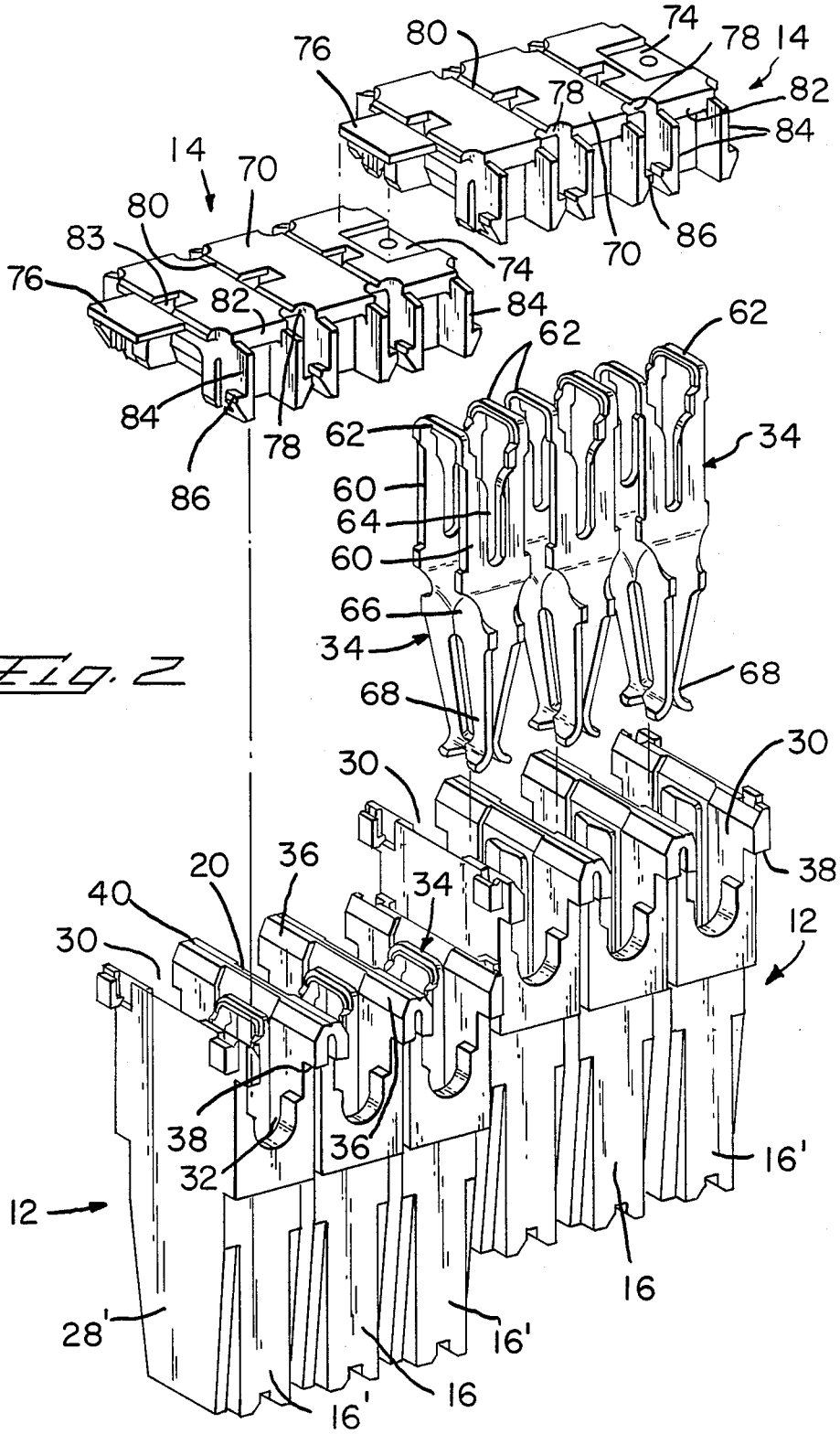
FIG. 2 is a perspective view of two housing segments which can be latched to each other to produce a single housing, this view also showing terminals exploded from the housing and closure members for the housing exploded from the housing.
Figure 4:
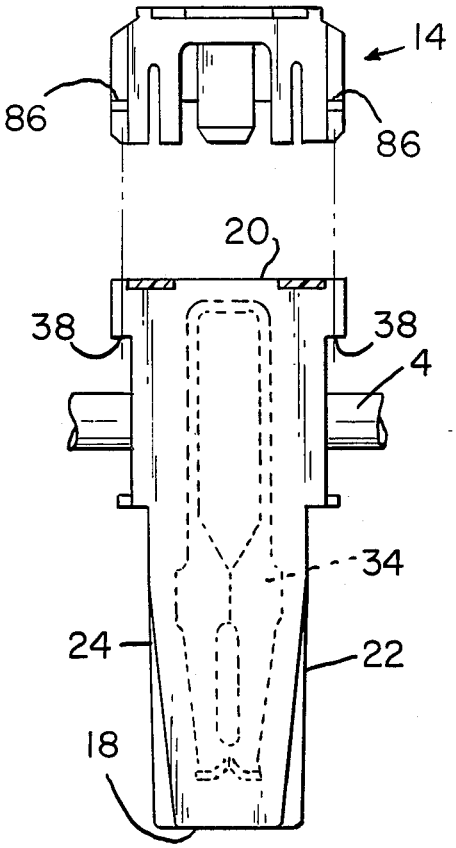
FIGS. 4 and 5 show an end view and a side view respectively of an individual housing cell.
Figure 5:
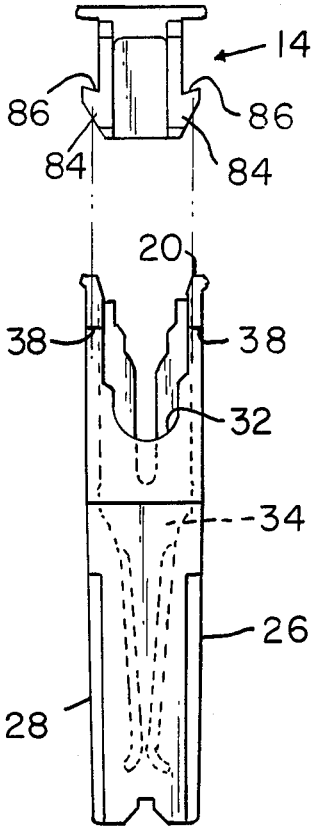

The connector 8 comprises a housing composed of at least one housing segment 12, the actual connector shown in FIG. 2 being made up of two identical housing segments 12. The housing contains terminals 34 and closure members as shown at 14 are inserted into the cavities in the connector as will be described.

Housing segment 12 comprises a plurality of individual housing cells 16, 16', the cells 16' being at the ends of the segment and the cells 16 being between the ends. Each cell has a cell mating end 18, a cell conductor receiving end 20, oppositely facing cell sidewalls 22, 24 and oppositely facing cell endwalls 26, 28. The endwalls of the end cells 16' differ from the endwalls of the intermediate cell 16 and are identified at 26',28'.

A conductor receiving cavity 30 extends through each cell from the mating end 18 to the conductor-receiving end 20 and the sidewalls 22, 24 and each provided with a wire admitting slot 32 which extends from the wire-receiving end inwardly of the sidewalls. The intermediate cells 16 in the segment are physically connected to the next adjacent neighboring cells by spaced-apart cell webs 36 which extend between the opposed endwalls at the wire receiving end of the cells. These cell webs extend laterally beyond the cell sidewalls 22, 24 and provide shoulders 38 which are directed towards the mating end 18 of the cell. The webs between juxtaposed cells are not continuous but are provided only in the vicinity of the sidewalls for reasons which will be discussed below and the webs are provided with aligned kerfs 40 so that a sharp cutting blade can be positioned in these kerfs and pushed into the webs to separate adjacent cells from each other.

Figure 6:
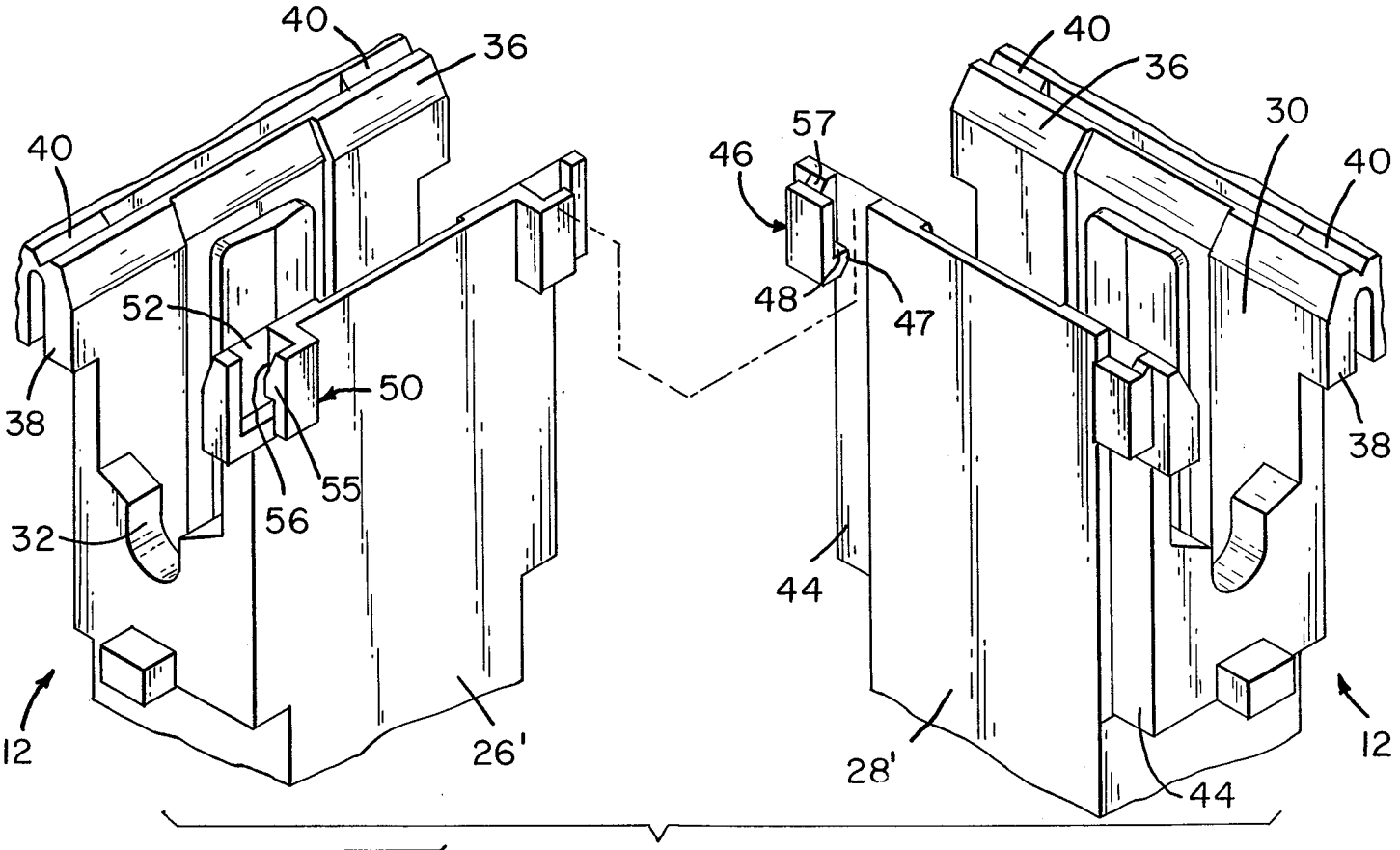
FIG. 6 is a fragmentary perspective view showing the opposed endwalls of adjacent housing segments, this view showing the endwalls in an orientation which reveals features of the endwall latches by means of which the segments are secured or latched to each other.
Figure 7:
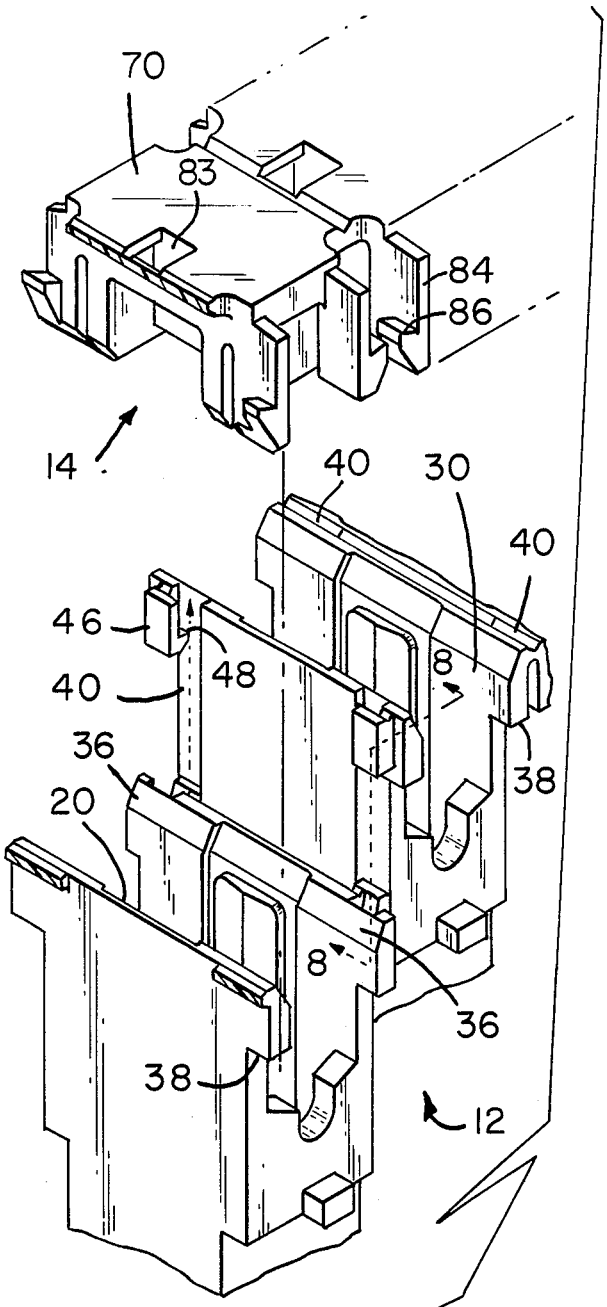
FIG. 7 is a view similar to FIG. 6 but showing the endwalls of the segments adjacent to each other in positions such that they can be moved into latched engagement with each other.
Figure 8:
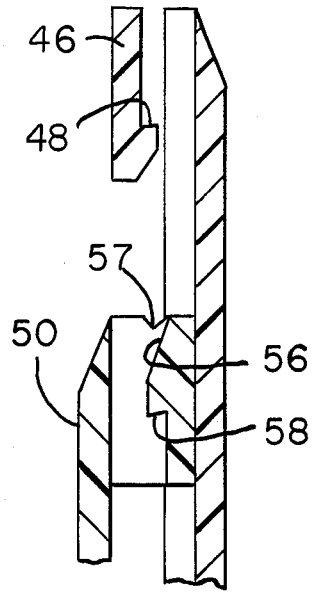
FIG. 8 is a view taken along the lines 8—8 of FIG. 7 and shows the latches in cross section.
Figure 9:
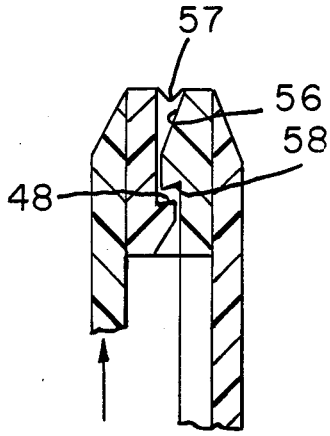
FIG. 9 is a view similar to FIG. 8 but showing the positions of the latches after the housing segments have been latched to each other.

The two segments 12 shown in FIG. 2 are secured to each other by latches on the opposed endwalls 26', 28' of the end cells of the two segments as shown best in FIGS. 6 and 7. The latches 46 on the endwall 28' comprise L-shaped extensions adjacent to the projecting portions of the webs, the free ends of the extensions being directed inwardly and towards each other. The arms have inwardly directed flanges 47 which provide upwardly facing shoulders 48, see FIG. 8. These flanges 47 are opposed to elongated recesses 44 which extend along the side edges of the endwall 28'. The hinges 50 on the endwall 26' also comprise L-shaped extensions and the free arm of the extension has an inwardly directed ear 55 which is opposed a recess 52 in endwall 26'. The ear 55 has a ramp portion 56 which extends to a downwardly facing shoulder 58 which is also shown in FIG. 8. The L-shaped extensions are capable of limited pivotal movement so that when the endwalls 26', 28' of two segments 12 are positioned as shown in FIG. 7 with the left-hand segment at a lower level than the right-hand segment and with the L-shaped extensions in the recesses 44, the two segments can be moved in the directions of the arrows until the latches engage each other as shown in FIG. 9. After latching, the spacing between the center lines of the adjacent cells that are latched to each other will be the same as the spacing between two intermediate cells in the segment. This means that a connector can be produced containing more than one segment 12 and the center-to-center spacing of the cavities will be constant from one end of the connector to the other.

Figure 11:
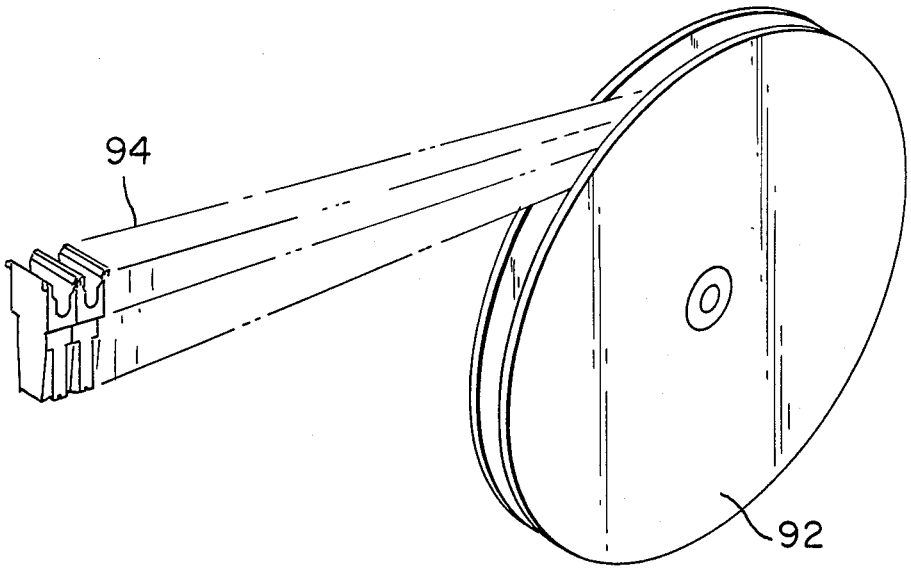
FIG. 11 is a view showing a reel having a continuous strip of housing material wound thereon.

It will be apparent from FIG. 9 that segments which are latched to each other can be severed in the manner described above and in fact a kerf may be provided as shown at 57 to assist in centering and locating the cutting edge. It should be mentioned that the latches shown in FIGS. 7-9 is designed for only a single usage so that the segments can be produced in a molding process and latched together to produce a continuous strip of housing material as shown in FIG. 11.

Each of the terminals 34 comprises a pair of parallel plate like members 60 having the upper ends as viewed in FIG. 2 connected by spaced-apart straps 62. Wire receiving slots 64 are provided in the plate members so that wires can be moved laterally of their axes and into the slots. Each plate member 60 has an adjoining transition section 66 from which extends a pair of spring arms 68 which will receive a tab type terminal. Terminals of the type shown at 34 are described more fully in U.S. application Ser. No. 485,763, filed Apr. 18, 1983, now U.S. Pat. No. 4,527,857.

The individual closure members 70 for the individual cells are also provided as segments 14 and the individual segments can be joined to each other by means of an ear 76 extending from one end of each segment and a recess 74 at the other end of the segment. The ears can be welded or bonded in any suitable manner in the recesses to produce a continuous strip of closure material.

Individual closure members 70 which are between the ends of segments are connected to each other by webs 78 that are located centrally between the side edges of the segment. The webs 78 are provided with kerfs 80 which are in alignment with the kerfs 40 when the closures are assembled to the cells of the connector. A single cutting edge can therefore be pushed through the closure kerf and the housing kerfs 40 to separate adjacent cells and adjacent closures from each other.

The undersides of the closure members are provided with insertion punches or pushers (not specifically shown) which push the wires 4 into the wire receiving slots 64 of the terminals when the closures are assembled to the cells. The individual closures also have spaced-apart latch arms 84 on their side edges 82 and the latch arms have upwardly facing shoulders 86 as viewed in FIG. 2 which are cooperable with the shoulders 38 of the housing cells. After assembly of a closure to a housing cell, the closure will be retained in the cell and will provide assurances that the wire 4 is being held in the wire receiving slots of the terminal by the closure. The closures have openings to permit insertion of an electrical probe as shown at 83.

Figure 10:
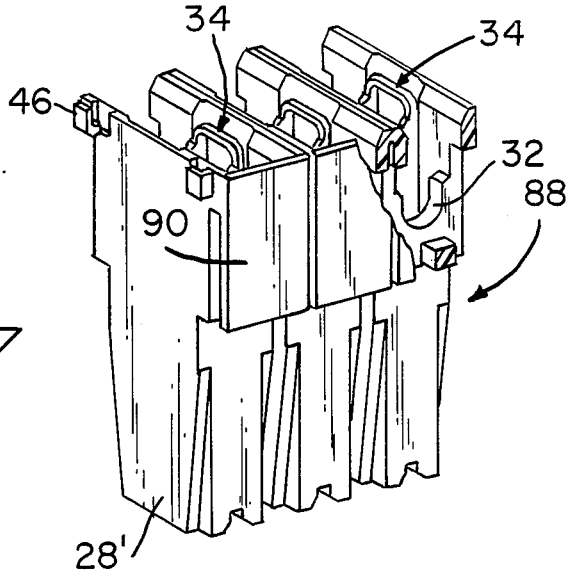
FIG. 10 is a perspective view showing an alternative type of housing segment.

FIG. 10 shows a segment 88 of housing cells which are similar to the previously described cells 16 excepting that a wire admitting slot is provided on only one of the cell sidewalls and the other sidewall is completely closed as shown by the wall 90, the shoulders 38 are behind the wall. This type of housing cell is intended to be applied to a wire end and the exposed cut end of the wire will then be covered by the closed sidewall 90.

A connector 6 or a connector 8 of any desired size can be produced by latching together the desired number of segments 12. The segments may contain more than three individual cells and in fact, a six cell segment may be preferable for many manufacturing operations. If a standard six cell segment is used, a connector 6 having an intermediate number of terminals, say nine terminals, is produced be latching two six-cell segments to each other and cutting off the three cells which are not required. The connector thus produced would be composed of a six-cell segment and a three-cell segment with the two segments being latched to each other as described above.

A composite connector as shown at 10 can be produced by latching together a segment 12 and a segment 88 and cutting off the cells which are not required in the connector.

Figure 12:
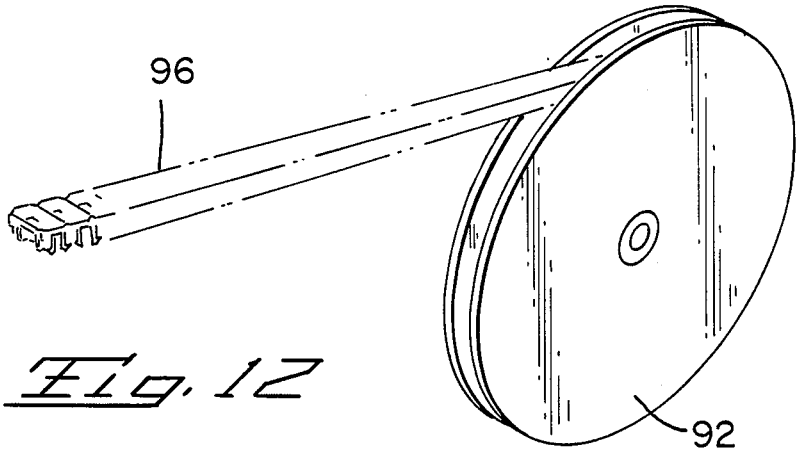
FIG. 12 is a view showing a reel of closure strip material.

It will be apparent from the foregoing that a harness manufacturer can satisfy a wide range of requirements for connectors as regards the number of terminals in each connector and the type of connector (feed-through, wire end, or composite) with housing material in continuous strip form as described above. The manufacturer would merely be required to maintain a stock of housing strip material composed of segment 12, a stock of strip material composed of segments 88, and a stock of closure strip material composes of segments 14. As shown in FIGS. 11 and 12, the housing strip material 94 and the closure strip material 96 can be wound on reels 92 for convenience in storage and transportation and additionally, automatic and semi-automatic tooling may be provided to remove strip material from the reels and deliver it to automatic or semi-automatic application machinery.

While FIG. 1 shows a harness composed of discrete wires, connectors in accordance with the invention can be used with cables in which the wires are all contained in a continuous body of insulation.

We claim:

1. A multi-contact electrical connector assembly of the type comprising a connector housing and end closure members, the housing having a mating face and a wire-receiving face which faces oppositely with respect to the mating face, oppositely facing housing sidewalls and oppositely facing housing endwalls extending from the mating face to the wire-receiving face, a plurality of cavities extending through the housing from the wire-receiving face to the mating face, the cavities being side-by-side in a row which extends between the housing endwalls, each of the cavities having an electrical contact terminal therein of the type having a wire receiving slot adjacent to the wire-receiving face, at least one of the housing sidewalls having wire admitting slots therein at the wire-receiving face which are in alignment with the terminals so that wires can be moved laterally of their axes and inserted into the wire-receiving slots and the inserted wires will then extend through the wire-admitting slots, the end closure members being dimensioned for insertion into the cavities at the wire receiving face to retain the wires in the slots in the terminals, the connector assembly being characterized in that:

the housing comprises a plurality of individual housing cells, the cells being connected to each other by integral connecting cell webs which extend between the cells at the wire-receiving face, the cells having a predetermined pitch, the end closure members are in strip form being connected to each other by closure webs, the cell webs and the closure webs being in alignment when the closures are inserted into the cavities, the cell webs and the closure webs being severable without removal of material upon relative movement of a severing blade through the cell webs and the closure webs and, the assembly has one juxtaposed pair of cells which are connected to each other by interengaged latches which are provided in the juxtaposed pair of cells at the wire-receiving face of the connector, the pitch of the one juxtaposed pair of cells being the same as the pitch of the remaining cells of the connector assembly, the interengaged latches being severable without removal of material upon relative movement of a severing blade through the interengaged latches.

2. A multi-contact electrical connector assembly as set forth in claim 1 characterized in that the cell webs, the closure webs and the interengaged laches have cell, closure and latch kerfs, respectively, the closure kerfs being in alignment with either the cell kerfs or the latch kerfs when the closure members are inserted into the cavities.

3. A continuous strip of connector housing material which, when severed, produces multi-contact electrical connectors, the multi-contact electrical connectors thus produced each comprising an insulating housing having a mating face and a wire-receiving face which faces oppositely with respect to the mating face, oppositely facing housing sidewalls and oppositely facing housing endwalls extending from the mating face to the wire-receiving face, a plurality of cavities extending through the housing from the wire-receiving face, the cavities being side-by-side in a row which extends between the housing endwalls, each of the cavities having an electrical contact terminal therein of the type having a wire receiving slot adjacent to the wire-receiving face, at least one of the housing sidewalls having wire admitting slots therein at the wire-receiving face which are in alignment with the terminals so that wires can be moved laterally of their axes and inserted into the wire-receiving slots and the inserted wires will then extend through the wire-admitting slots, the continuous strip of connector housing material being characterized in that:

the strip comprises a continuous string of housing cells, each cell having a mating cell face and a wire-receiving cell face which faces oppositely with respect to the mating cell face, each cell having oppositely facing cell sidewalls which face laterally of the strip and oppositely facing cell endwalls, juxtaposed cells in the strip having their endwalls opposed to each other, juxtaposed cells in the string being connected to each other by integral cell webs which extend between the juxtaposed cells at the wire-receiving faces thereof, juxtaposed cells being severable from each other without removal of material upon severing the cell webs connecting the juxtaposed cells, and a continuous closure strip of end closure members, the individual end closure members of the closure strip being insertable into the individual cells at the wire-receiving faces thereof, the cell webs, the closure webs and the interengaged latches having cell, closure and latch kerfs respectively, the closure kerfs being in alignment with either the cell kerfs or the latch kerfs when the closures are inserted into the cavities, whereby a multi-contact electrical connector is produced by severing the desired number of cells from the end of the strip, the cell sidewalls of the severed cells constituting the sidewalls of the connector housing, the continuous strip being made up of a series of segments, each segment comprising a plurality of cells, the cells at the ends of each segment being connected to the end cells of juxtaposed segments by interengaged latches, the interengaged latches being severable without removal of material upon relative movement of a severing blade through the interengaged latches.

* * * * *